United States Patent [19]

Enneper et al.

[11] Patent Number: 4,579,409

[45] Date of Patent: Apr. 1, 1986

[54] LOCKABLE ELECTRICAL FLAT PLUG RECEPTACLE AND ELECTRICAL CONNECTOR WITH IT

[75] Inventors: Klaus Enneper, Radevormwald; Heinrich Keunecke, Remscheid, both of Fed. Rep. of Germany

[73] Assignee: Kabelwerke Reinshagen GmbH, Fed. Rep. of Germany

[21] Appl. No.: 558,168

[22] Filed: Dec. 5, 1983

[30] Foreign Application Priority Data

Dec. 4, 1982 [DE] Fed. Rep. of Germany ..... 3244939

[51] Int. Cl.[4] ..... H01R 13/115

[52] U.S. Cl. ..... 339/74 R; 339/258 S

[58] Field of Search ..... 339/74 R, 256 SP, 258 S

[56] References Cited

U.S. PATENT DOCUMENTS 4,415,221 11/1983 Katsuki ..... 339/74 R

FOREIGN PATENT DOCUMENTS 467531 2/1969 Switzerland ..... 339/258 S

*Primary Examiner*—Joseph H. McGlynn

*Attorney, Agent, or Firm*—Reising, Ethington, Barnard, Perry & Milton

[57] ABSTRACT

A lockable electrical connector with a receptacle and a flat plug is disclosed. The receptacle comprises a duct-shaped plug receiver with arched-over walls terminating in a free edge segments. A tongue unitary with a bottom wall is bent back into the receiver and the flat plug is received between the free edge segments and the tongue. The tongue has a tang coacting with an opening in the flat plug to secure it against removal from the receptacle. A release cam on the free end of the tongue coacts with a cam on the casing to bend the tongue for removal of the tang from the opening to allow removal of the flat plug from the receptacle.

7 Claims, 6 Drawing Figures

LOCKABLE ELECTRICAL FLAT PLUG RECEPTACLE AND ELECTRICAL CONNECTOR WITH IT

FIELD OF THE INVENTION

This invention relates to electrical connectors and more particularly, it relates to a lockable flat plug receptacle formed of sheet metal.

BACKGROUND OF THE INVENTION

Electrical connectors of the flat plug and receptacle type are commonly used in electrical circuits associated with machinery, especially automotive vehicles, in which they are subjected to vibrations and other forces. In such applications, the electrical connector must afford good electrical contact and, at the same time, it must provide a releaseable connection between the flat plug and the receptacle.

Lockable flat plug receptacles are known in the prior art which are formed from sheet metal with a substantially duct-shaped plug receiver with a bottom wall and with side walls which are arched-over the bottom wall to receive the flat plug. A tongue which is unitary with the bottom wall and which is bent back into the inside of the receiver is provided with a tang which is adapted to coact with an opening in the flat plug to secure it against being pulled out of the receptacle. In such receptacles, it is known to provide a releasing means on the free end of the tongue which is operable to bend the tongue away from the flat plug to release the plug and allow it to be removed from the receptacle.

A variety of forms of lockable electrical flat plug receptacles have been proposed. A connector with a lockable receptacle which is releaseable by being pushed inside a case is disclosed in U.S. Pat. Nos. 3,796,987 and 3,976,348 and from German published patent application Nos. 2,518,003 and 2,924,596. In this prior art, the tongues extend backward beyond the receiver and are bent at an angle to form a releasing means.

SUMMARY OF THE INVENTION

In accordance with this invention, a lockable flat plug receptacle is provided which requires only a short length of tongue even though the tongue carries a releasing element. This permits the receptacle to be made from a narrow strip of sheet metal. This is accomplished in a receptacle with a duct-shaped plug receiver having an arched-over wall, a tongue unitary with a bottom wall and bent back into the receiver, the tongue and a free edge segment of the side wall being adapted to receive the flat plug therebetween, a tang on the tongue adapted to coact with an opening in the flat plug to secure it against removal, and releasing means on the free end of the tongue for bending the tongue to remove the tang from the opening to allow removal, by the improvement comprising a shoulder on the side wall extending along the duct with a slot in the side wall laterally adjacent the free end of the tongue, and a tab on the free end of the tongue with a portion extending downwardly through the slot and including a first cam face adapted to coact with a cam element when the receptacle is slidably moved relative to the cam element and thereby deflect the tongue away from the free edge segment.

This construction affords the advantage that the point of action on the releasing element is located between the locking tang and the rear end of the flat plug receptacle and this is achieved despite the arrangement of the bent over tongue. Due to the short distance between the point of action and the locking tang, only a slight deflection of the free end of the tongue is required in order to remove the tang from the opening in the flat plug. The releasing element does not overhang bottom or edge segments of the receptacle and the construction height of the receptacle and is thereby reduced. Further, this permits the insertion point for the flat plug to be centrally located between the edge segments.

One embodiment of the invention provides that each shoulder includes at least one protruberance extending in the direction of the free edge segments. The free edge segments may be curved inward toward the bottom and then terminate in a short segment turning away from the bottom to provide a rounded edge for contact with the flat plug. By this construction, it is possible for the surfaces of the sheet metal to be surface treated, for example tinned, even before the punching and bending. The bow-shaped supporting surfaces in the edge segments and the protruberances are then also surface treated, for example coated with tin, after the punching and bending. Moreover, the arched-over edge segments behind the free end of the tongue may be provided with fingers which extend downward and terminate under the tongue to limit the insertion distance for the flat plug. Further, the tongue is provided with two tabs with respective cam faces in a symmetrical arrangement. Each tab comprises a part extending in the plane of the tongue and a part extending perpendicularly to the tongue through a slot in the shoulder.

An electrical connector with a flat plug receptacle according to this invention has an insulating casing in which the flat plug receptacle is axially movable between two stops and in which at least one bottom wall part is provided with a cam face extending obliquely upward which coacts with a cam face on one of the tabs of the tongue. Sliding engagement causes the tongue to be deflected to release the tang from the opening in the flat plug. This arrangement permits a very low construction height of the casing.

BEST MODE FOR CARRYING OUT THE INVENTION

Figure 1:
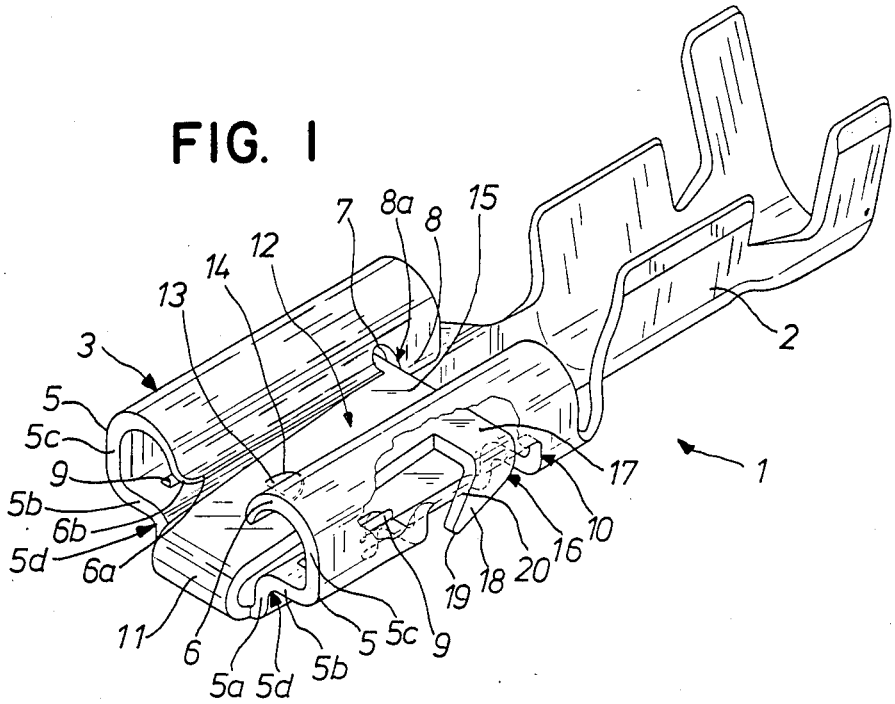
FIG. 1 shows a perspective view of the flat plug receptacle of this invention.

Referring now to the drawings, there is shown an illustrative embodiment of the invention in a flat plug receptacle formed from sheet metal. The receptacle is adapted to be retained in a plastic connector casing with a connecting lug for connection of the receptacle with a wire conductor. The front end of the flat plug receptacle is adapted to receive a flat plug. The receptacle is especially adapted for use in an automotive vehicle electrical system. It will be appreciated as the description proceeds that the invention is useful in other applications and in other embodiments.

Figure 2:
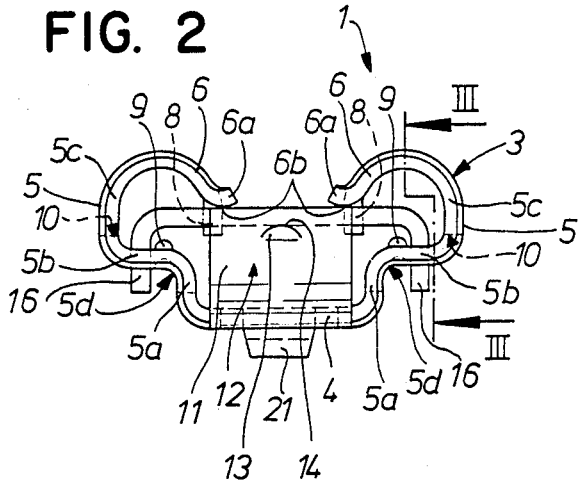
FIG. 2 shows a front end view of the receptacle as seen from the left side of FIG. 1.

The flat plug receptacle 1, as shown in FIGS. 1 and 2, comprises in general, a plug receiver 3 and a wire receiver or connecting lug 2. The receptacle 1 is symmetrical about its longitudinal axis and, for the sake of brevity, the same reference characters will be used to designate the same parts. It will be understood that when the description is given with reference to one side of the receptacle, it will be equally applicable to the other side.

The plug receiver 3 of the receptacle includes a central bottom wall 4 which has an adjoining stepped side wall 5. The side wall 5 comprises a first wall segment 5*a* which extends perpendicularly from the bottom wall 4, a second wall segment or lateral shoulder 5*b* which extends approximately parallel to the bottom wall 4 and a third wall segment 5*c* which extends perpendicularly to the bottom wall 4; the wall segment 5*c* extends into a free edge segment 6 of arcuate cross-section which turns toward the bottom wall 4. The edge segment 6 terminates in an end 6*a* which is turned away from the bottom wall 4. The edge segment 6 is thus provided with a rounded edge 6*b* which points toward the bottom wall 4. To provide a stop for the flat plug to be received, the edge segment 6 is provided with a finger 8 separated by a notch 7 from the edge segment 6. The finger 8 is bent further downward toward the bottom wall 4. A protruberance 9 is pressed out from the shoulder 5*b* in the plug receiver 3 and is rounded on the upper surface. The first wall segment 5*a* and the shoulder 5*b* define a recess or channel 5*d* extending from the front end of the receiver 3 to the notch 7. At the rear portion of the receiver 3, the first and second wall segments 5*a* and 5*c* are provided with a slot 10.

A tongue 11, which is somewhat narrower than the distance between the two wall segments 5*a*, is unitary with the bottom wall 4 and extends from the front end thereof. The tongue 11 is bent upward and backward by 180 degrees in the direction of the bottom wall 4 and extends obliquely thereof. The tongue 11 terminates inside the plug receiver 3 and is disposed with the upper face 12 thereof at the rear end in engagement with the rounded edge 6*b* of the edge segment 6. In the central region of the tongue 11 a barb or tang 13 is punched out upwardly of the plane of the tongue 11. The tang 13 terminates in a stopping edge 14 for engagement with the flat plug to be inserted, as will be described subsequently with reference to FIG. 4. A releasing element comprises a flap or tab 16 extending laterally from the rear end 15 of the tongue 11. The tab 16 has a part 17 which extends in the plane of the tongue 11 and has a part 18 which extends perpendicularly to the part 17. The part 18 of the tab 16 passes through the slot 10 with a clearance and extends below the shoulder 5*b* into the channel or recess 5*d*. The part 18 of the tab 16 has a rounded-off nose 19 which projects forward toward the front end of the receiver 3. The part 18 of the tab 16 has a ramp edge or cam surface 20 which extends obliquely of the tongue 11. For locking the receptacle 1 in a casing, a barb or tang 21 is punched out of the central region of the bottom wall 4 in the downward direction.

As shown in FIGS. 3 through 6, the flat plug receptacle 1 is enclosed within a casing 22 which is made of an insulating plastic, suitably polyamide, to form an electrical connector 23. The casing 22 is symmetrical about its longitudinal axis and includes a duct-like passage 24 having an upper wall 25, a lower wall 26 and side walls 27 and 28. A groove 29 extends from the front end of the casing 22 to a shoulder 30 in the lower wall 26. The shoulder 30 is adapted to be engaged by the barb or tang 21 on the bottom wall 4 of the receptacle 1 to lock the receptacle in place. Additional locking of the receptacle 1 is provided by a bendable strip 31 formed on the upper wall of the casing 22. The strip 31 has an end face 32 which is disposed behind the finger 8.

The lower wall 26 includes a groove 33 which extends from the rear end of the casing 22 and terminates in a cam face 35. The cam face 35 extends obliquely of the bottom 36 of the groove 33 at an angle alpha of approximately 20 degrees and the cam face thus defines a triangular recess 34. The cam face 35 terminates in an edge 37 which adjoins a stop surface 38. The stop surface 38 extends to the bottom surface 39 of the passage 24. The casing 22 is provided on the front end with bevelled edges 40 disposed on opposite sides of the passage 24 to facilitate insertion of the flat plug, as will be described subsequently.

Figure 3:
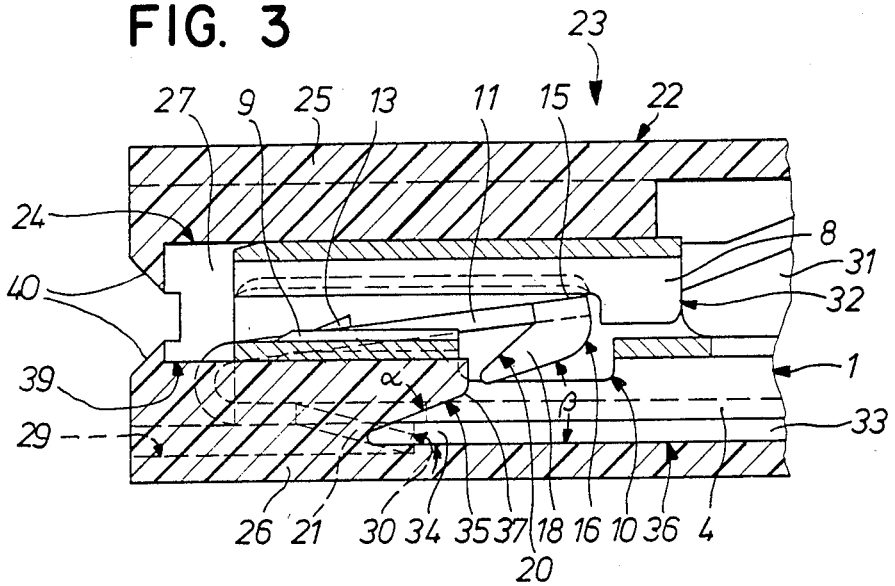
FIG. 3 shows a partial section through a connector including the flat plug receptacle and a casing, the section of the receptacle being taken on line III—III of FIG. 2 and the section of the casing being taken on line IV—IV of FIG. 5.

The flat plug receptacle 1 is inserted into the casing 22 from the rear end until the tang 21 snaps into the groove 29 and is held fast by the shoulder 30, as depicted in FIG. 3. Additional locking is provided by the bendable strip 31 which is deflected during the insertion of the receptacle 1 and which rests behind the stop face 32 at the rear end of the receptacle 1. With the receptacle 1 inserted in the casing 22 the tab 16 which is located in the slot 10 is disposed so that the part 16 will strike against the stop face 38 upon further insertion. Thus, the receptacle 1 is secured against movement in the casing 22 in both axial directions with a predetermined amount of clearance, as best shown in FIG. 3.

Figure 4:
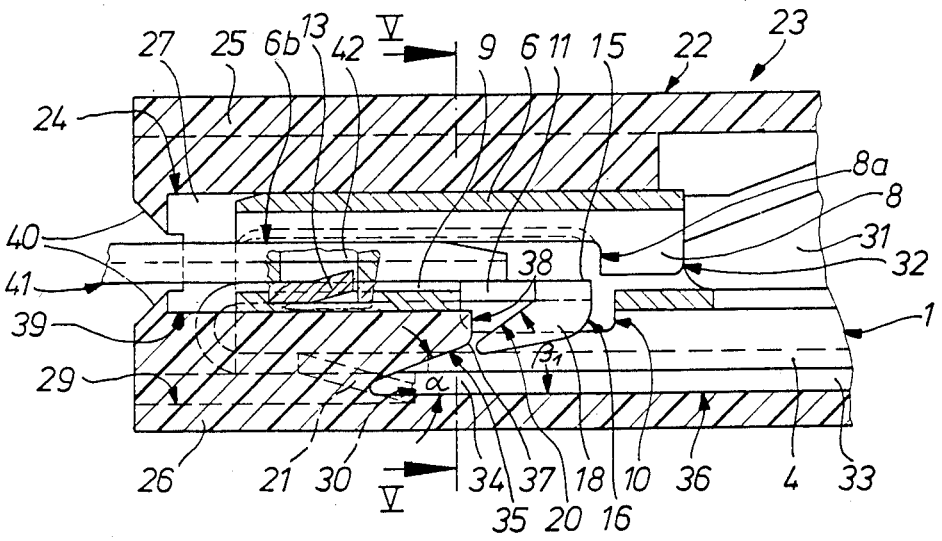
FIG. 4 shows the same partial section as FIG. 3 but with a flat plug inserted.
Figure 5:
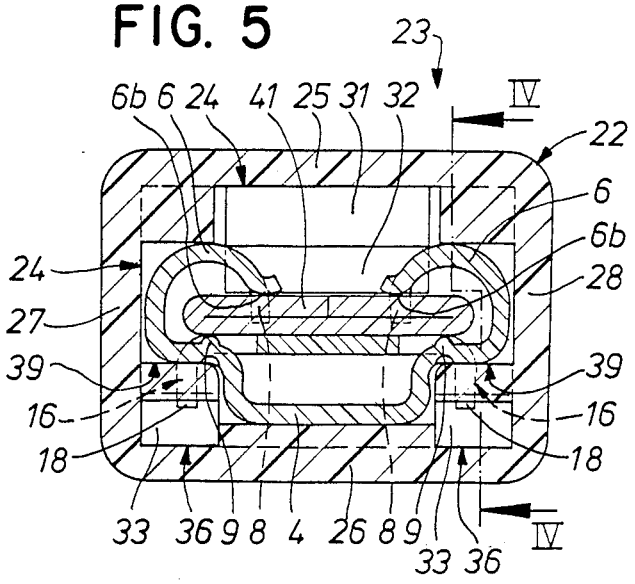
FIG. 5 shows a cross-section through the connector taken on line V—V of FIG. 4.
Figure 6:
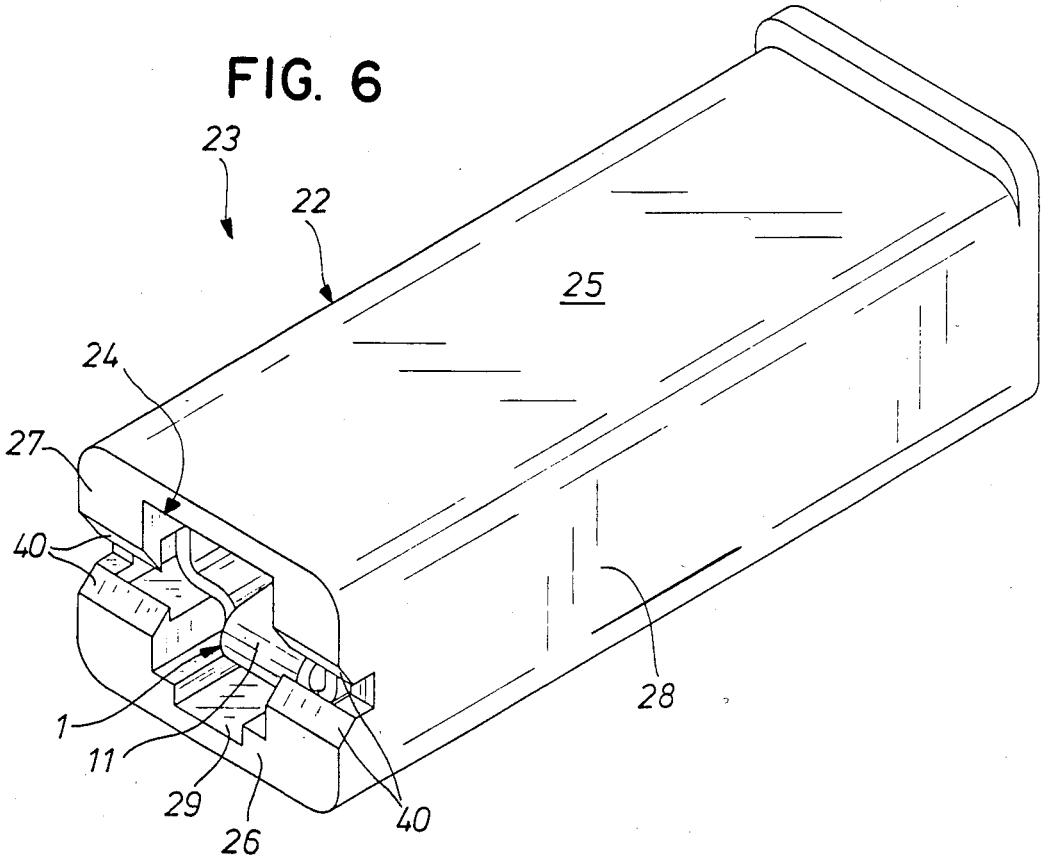
FIG. 6 shows a perspective view of the connector according to the invention with the flat plug receptacle inserted into the casing.

The connection of the receptacle 1 with a flat plug 41 by insertion of the flat plug into the electrical connector 23 is illustrated in FIGS. 4 and 5. The flat plug 41, suitably formed of folded sheet metal, has an opening 42 adapted to coact with the tang 13 on the tongue 11. The connection is made by pushing the flat plug 41 between the tongue 11 and the rounded edge 6*b* of the edge segment 6 until the tang 13 mates with the opening 42. This insertion of the flat plug 41 causes the tongue 11 to bend toward the bottom wall 4 so that the part 18 of the tab 16 is moved toward the bottom wall with the cam face 20 disposed opposite the edge 37 of the cam face 35. In this position, the cam face 20 forms an angle beta of about 35 degrees with the lower wall 26 of the casing 22. The insertion of the flat plug 41 causes the edge segment 6 to be deflected somewhat and the flat plug is clamped between the edge segment and the protruberance 9, as best shown in FIG. 5. The tang 13, being disposed in the opening 42, seats against the tongue 11 to prevent the electrical connection from being separated by pulling the flat plug 41 from the receptacle 1. The insertion of the flat plug 41 into the receptacle 1 is limited by the finger 8 which is disposed opposite the free end 15 of the tongue 11 and provides an axial stop 8*a*.

It will be appreciated that the electrical connection of the flat plug 41 and the receptacle 1 cannot be separated without movement of the tang 13 out of the opening 32 in the tongue 11. For the purpose of separating the plug 41 from the receptacle 1, the tongue 11 may be deflected further toward the bottom 36 by the coaction of the cam face 20 of the tab 16 with the cam face 35, as follows. The flat plug 41 is held firmly and the casing 22 of the receptacle 1 is pulled away from the flat plug. This causes the cam face 20, which extends at an angle beta of about 30 degrees to the bottom 36, to strike against the edge 37; further movement of the casing 22 causes the edge 37 to slide over the cam face 20 and pull the tab 16 down toward the base surface 36. The movement of the tab 16 carries the tongue 11 downward toward the bottom wall 4 of the receptacle. This movement allows the tang 13 of the tongue 11 to come out of the opening 42 in the flat plug 41 and the locking therebetween is released. This permits the flat plug 41 to be withdrawn from the receptacle 1 by merely overcoming the relatively weak clamping forces between the rounded edge **6*b* and the protruberance 9 and thus the connection of the plug 41 and receptacle 1** is separated.

Although the description of the this invention has been given with reference to a particular embodiment, it is not to be construed in a limiting sense. Many variations and modifications will now occur to those skilled in the art. For a definition of the invention reference is made to the appended claims.

What is claimed is:

1. In a lockable receptacle for a flat plug, said receptacle being of the type comprising a plug receiver which is substantially duct-shaped with a bottom wall and a pair of opposed side walls arched-over the bottom wall each terminating in a free edge segment, a tongue unitary with the bottom wall and which is bent back into the plug receiver, said free edge segments of the side walls and the tongue being adapted to receive said flat plug therebetween, said tongue having a tang extending therefrom and adapted to coact with an opening in the flat plug to secure it against removal from the receptacle, and releasing means on the free end of the tongue for bending the tongue to remove the tang from said opening to allow removal of said flat plug, the improvement wherein:

each side wall includes a wall segment which extends perpendicularly from said bottom wall and a lateral shoulder which extends approximately parallel to said bottom wall, said wall segment and said shoulder defining a recess extending along said duct-shaped receiver between the lateral edge of said bottom wall and the lateral edge of said shoulder, said shoulder defines a slot laterally adjacent the free end of said tongue, and said releasing means comprises a tab on the free end of said tongue having a portion extending downwardly through said slot into said recess and terminating at a location below said shoulder, said portion including a first cam face below said shoulder and within said recess for bending said tongue away from said free edge segment.

2. The invention as defined in claim 1 wherein said shoulder includes at least one protruberance extending in the direction of the free edge segments.

3. The invention as defined in claim 1 wherein the free edge segment is curved inwardly toward the bottom wall and terminating in a segment curved away from the bottom wall.

4. The invention as defined in claim 1 wherein each side wall includes a finger adjacent the free end of the tongue and extending downward to a point below the free end of the tongue to limit the insertion of said flat plug.

5. The invention as defined in claim 1 including, an insulating casing including first and second stops, a lower wall and at least one second cam face extending obliquely upward from said lower wall, said receptacle being axially movable along said lower wall between said stops with the first cam face of at least one tab being engageable with one second cam face, said cam faces being disposed within said recess between said shoulder and said lower wall, whereby sliding motion of said receptacle relative to said casing causes engagement of the cam surfaces and flexible bending of said tongue to release said flat plug.

6. The invention as defined in claim 1 wherein said releasing means comprises two tabs on the free end of the tongue with one tab on each side thereof in a symmetrical arrangement, each of said tabs comprising a lateral part extending in the plane of the tongue and a perpendicular part extending toward the bottom wall through said slot into said recess.

7. The invention as defined in claim 6 including, an insulating casing including first and second stops, a lower wall and two cam faces extending obliquely upward from said lower wall, said receptacle being axially movable along said lower wall between said stops with the first cam face of each tab being engageable with a second cam face, said cam faces being disposed within said recess between said shoulder and said lower wall, whereby sliding motion of said receptacle relative to said casing causes engagement of the cam surfaces and flexible bending of said tongue to release said flat plug.

* * * * *